United States Patent [19]

Tur

[11] 4,139,660

[45] Feb. 13, 1979

[54] METHOD FOR INCREASING SOLID SURFACE TENSION

[75] Inventor: Wladimir Tur, Zurich, Switzerland

[73] Assignee: Bernhard Joos, Zurich, Switzerland

[21] Appl. No.: 689,149

[22] Filed: May 24, 1976

Related U.S. Application Data

[63] Continuation of Ser. No. 149,770, Jun. 3, 1971, abandoned, which is a continuation-in-part of Ser. No. 738,027, Jun. 18, 1968, abandoned, which is a continuation-in-part of Ser. No. 381,477, Jul. 9, 1964, abandoned.

[30] Foreign Application Priority Data

Jul. 16, 1963 [CH] Switzerland ..... 8839/63

[51] Int. Cl.[2] ..... C23C 3/02; B05D 3/00

[52] U.S. Cl. ..... 427/353; 428/539

[58] Field of Search ..... 427/322, 353; 252/170, 252/171; 106/287, 287 R; 428/539

[56] References Cited

U.S. PATENT DOCUMENTS

| | | | |
|---|---|---|---|
| 1,561,650 | 11/1925 | Lashar | 427/353 X |
| 2,315,259 | 3/1943 | Hyde | 427/353 |
| 2,602,757 | 7/1952 | Kantrowitz et al. | 427/322 X |
| 3,689,292 | 9/1972 | Preston | 427/353 |

FOREIGN PATENT DOCUMENTS

| | | | |
|---|---|---|---|
| 802097 | 12/1968 | Canada | 427/353 |
| 1519547 | 7/1974 | Fed. Rep. of Germany | 427/353 |
| 1402310 | 5/1965 | France | 427/353 |
| 731137 | 12/1966 | Italy | 427/353 |
| 1079391 | 8/1967 | United Kingdom | 427/353 |

*Primary Examiner*—Michael R. Lusignan

*Attorney, Agent, or Firm*—Wenderoth, Lind & Ponack

[57] ABSTRACT

Method of increasing the surface tension or specific surface energy of normally solid substrates by contacting same with a compound or compounds of certain metals selected from the IVth Group of the Periodic Table, in order to render the substrates permanently wettable to fluids.

14 Claims, No Drawings

METHOD FOR INCREASING SOLID SURFACE TENSION

This application is a continuation of Ser. No. 149,770, filed June 3, 1971, now abandoned, which in turn is continuation-in-part of Ser. No. 738,027, filed June 18, 1968, now abandoned, which in turn is a continuation-in-part of Ser. No. 381,477, filed July 9, 1964, now abandoned.

This invention relates to the increasing of surface active properties of normally solid substrates. Still further, it relates to a method for easily and durably rendering wettable normally solid substrates by increasing their surface tension in order to conform more closely to the surface tensions of fluids to which the substrates are to be made wettable. Still further, this invention relates to liquid solutions and dispersions which may be used in carrying out the methods of this invention. Still further, this invention contemplates applications of new methods to make normally solid substrates wettable to fluids.

One of the objects of the present invention is to provide a method by which surfaces of normally solid substrates can be made wettable in a durable manner, merely by applying a liquid composition to the surface of the substrate and subsequently washing off the excess of the composition. A further object of this invention is to provide liquid compositions to be applied to the surface of the normally solid substrate. Another object of the invention is to provide normally solid substrates with protective layers having surface active properties, and compositions capable of forming such protective layers. Still further objects of the present invention will become apparent from the following specification wherein the aforementioned objects are discussed in greater detail.

It is a well-known phenomenon that the surfaces of most normally solid substrates, when contacted with fluids, show a certain degree of non-wettability. That is, the fluids, especially liquids like water, do not spread on the solid surface as a thin film but contract to form droplets. To overcome this difficulty, so-called wetting agents are used in the liquid, and these wetting agents (or surfactants) reduce the surface tension of the liquid.

The term "surface tension" as used herein conforms to the scientific meaning and includes, more precisely, the interfacial tension between two phases. Surface tension is that property of matter, due to molecular forces, which exists in the surface film of all liquids and tends to bring the contained volume into a form having the least possible superficial area. Surface tension is numerically equal to the force acting at right angles to a line of unit length lying on the surface, and is also equal to the work required to enlarge the surface by a unit area (Webster's new International Dictionary, 1954). Such work is commonly called "specific surface energy". Of course technically, solid bodies do not show a "surface tension" since the cohesion of their molecules makes it impossible for the surface tension to act in diminishing the solid volume. In this case, "specific surface energy" applies since, when dividing the solid body, a certain part of the energy necessary for this size reduction is consumed to enlarge the surface.

Surface active agents (surfactants, wetting agents) have been for a long time considered as being capable of lowering the surface tension of liquids so that they spread more easily on non-wettable substrates with their lower specific surface energy. More recent investigations by P. J. Sell, Zeitschr. phys. Chem., Neue Folge 39, 322 (1963); A. W. Neumann and P. J. Sell, ibid. 41, 183 (1964); and P. J. Sell and A. W. Neumann, ibid. 41, 191 (1964), have made it possible to measure surface tensions of solid substrates. These investigators have found an equation of state between the fundamental interfacial energies:

$$F(\delta_s, \delta_f, \gamma_{sf}) = 0 \quad (1)$$

wherein F designates function, $\delta_s$ is the surface tension (or specific surface energy) of the solid body, $\delta_f$ is the surface tension of the fluid, and $\gamma_{sf}$ is the interfacial tension between solid and fluid in contact. On this base, measurements of solid surface tensions are now possible by using Young's equation $$\delta_s - \gamma_{sf} = \delta_f \cos\nu \quad (2)$$

or $$\delta_s = \delta_f \cos\nu + \gamma_{sf} \quad (3)$$

where $\cos\nu$ is the fluid-solid contact angle. By plotting $\delta_f \cos\nu$ -values of a given solid substrate ($\delta_f$ is known, $\cos\nu$ is measured) versus $\cos\nu$, for $\cos\nu = 1$ the value of $\delta_f \cos\nu$ equals $\delta_s$ (see K. L. Wolf et al., Dechema-Monographie, Vol. 51, p. 31–44). According to this method, the surface tension of a great number of solids have been measured. In Table I, some values are given which were measured by this new method.

Table I

Surface tension of solid surfaces

| Solid | surface tension, $\sigma_s$, at 20° C, erg/cm$^2$ or dyn/cm |
|---|---|
| (Perfluorheptyl)-methyl methacrylate | 12 |
| paraffine | 19 |
| polyethylene | 27–28 |
| polystyrene | 34 |
| Ultramid | 37–38 |
| polypropylene | 29.5 |
| PVC (hard) | 44.5 |
| PVC (soft) | 40 |
| Nylon | 48 |
| Teflon | 19 |
| rubber | 9.5 |
| aluminum | 30 |
| copper | 38 |
| bronze | 40 |
| steel | 32 |
| borosilicate glass | 65 |
| phosphate glass | 66.5 |
| lead silicate glass | 68 |
| silicate glass | 69.5 |
| quartz | 67 |

It is evident from equation (3) that, when $\nu$ is zero, $\cos\nu$ is 1, and to bring $\gamma_{sf}$ to zero, $\delta_s$ must be equal to $\delta_f$. In connection with Table I, it can be seen that glasses and quartz are, when clean, very easily wettable to pure water ($\delta_f = 72$ erg/cm$^2$) in accordance with the commonly known observation, whereas metals are not wettable to water but to oils ($\delta_f$ approx. 30 erg/cm$^2$).

The well-known better wettability of water by adding surfactants now finds its explication: The interfacial tension $\gamma_{sf}$ of solid and liquid.

It has now been found that, instead of decreasing the surface tension of the fluid in order to bring it within the neighborhood of the solid surface tension, the latter may be raised to approximate the surface tension of the fluid. The effect attained is the same, with the great additional advantage that the new higher surface tension of the solid surface is durable and cannot be suppressed except by strong mechanical treatment of the solid surface. In other words, the surface treated in accordance with this invention is always wettable by, for example water, without any necessity of adding surfactants to the water, and this wetting ability is conserved even after prolongated washing. If, for example, Teflon is coated with a Teepol solution or with pure Teepol, it is wettable with water, but when the Teepol has been dissolved by washing the substrate with water, the Teflon surface is as non-wettable as before. By the present method, Teflon surfaces are made perfectly wettable, and this wettability persists unless the Teflon surface is mechanically treated to remove the surface activity conferred by this method.

The new method according to this invention consists essentially of applying to the surface of the substrate a solution or dispersion in water, a water miscible organic solvent, or mixtures thereof of one or more compounds from the group of a halide, a basic halide, an oxide, a hydroxide, an acetate, an acetylacetonate or a haloacetylacetonate of germanium, tin, lead, titanium, zirconium, hafnium or thorium, and removing the excess solution or dispersion by thoroughly rinsing the surface of the substrate, with water. There must be substantially no reduction, decomposition or hydrolysis of the compounds during application.

The normally solid substrates which may be treated according to this new method are in practice not limited, i.e., there is no normally solid substrate the surface tension of which cannot be durably increased by this method. Of course, the treating procedure has to be adapted, according to the obvious considerations of those skilled in the art, to the general characteristics and properties of the substrate. For example, it is most evident that substrates which are soluble in organic solvents must not be treated with solutions or dispersions of the compounds to be used in the specific solvent. However, in some cases, it might be desirable to use a liquid treating composition which acts as a partial or poor solvent for the solid substrate just enough to slightly attack or swell its surface in order to better fix thereon the active compounds. Examples of this particular treatment will follow.

Other methods of application are well known to those skilled in the art. The effects obtained do not at all depend critically on the method of application. For instance, sprays may be applied wherein the active compound is propelled by a suitable propellant like the freons.

The term "fluid" as used herein comprises liquids as well as gases, liquid emulsions, mixtures, dispersions and the like being included. In contrast to the term "solid" in this application, the fluid is much less viscous. These terms "solid" and "fluid" are well known in the art and need no further explanation.

Observing the precautions discussed above, the following normally solid substrates can be effectively rendered wettable by the method of this invention:

(A) metals like iron, nickel, tungsten, aluminum, zinc, tin, copper, beryllium, cadmium, chromium, lead, magnesium, platinum, palladium, silver, gold, titanium, and their alloys, like brass, bronze, the different steels, monel, magnalium, manganin, constantan, solder, Hastelloy, etc.;

(B) plastics, such as polyethylene, polypropylene, polytetrafluoroethylene (Teflon), polystyrene, acrylics like polyacrylic or polymethacrylic esters, polyallyl compounds, polyvinyl resins like PVC, PVDC, PVA, polyvinylbutyrate; polyacrylamide, polyacrylonitrile; polyesters like polyethylene terephthalate or poly(bishydroxycyclohexyl) terephthalate, epoxy resins, cellulosic esters like acetyl cellulose, nitro cellulose, cellulose acetobutyrate; polyurethanes; phenolics like formaldehyde phenol resins (Bakelite), formaldehyde aniline resins, polyamides like nylon, Orlon or Perlon, compounded plastics, polyisoprene, polybutadiene, polysilicon compounds like polysilanes or polysiloxanes, polymerized aldehydes, copolymers and mixtures thereof;

(C) natural and synthetic resins or rosins such as ozocerite, paraffine, colophonium, ceresine, bituminous matter, tar, pitch, piceine, vaseline, etc.;

(D) wood, cellulose, rubber, leather, solid fatty acids like stearic or palmitic acid, fats, waxes, paper and paper products like cardboard, treated papers like coated and waxed paper and parchment;

(E) natural and synthetic fibers and textile or non-textile articles made of them like cotton, wool, silk; hairs, furs, horn, keratin, chitin, skins, etc.;

(F) natural and artificial stones, ceramics, concrete, glasses, faiences, enamels, minerals, graphite, etc.; and (G) all composite materials made from the above materials, such as painted or laquered substrates, anodized aluminum, ignifuged wood and paper, plastic coated metals like silicon or Teflon coated steel, enamelled porcelaine, etc.

The compounds of germanium, tin, lead, titanium, zirconium, hafnium and thorium which may be used in the practice of this invention are halides, basic halides, oxides, hydroxides, acetates, acetylacetonates and haloacetylacetonates. Examples of the halide group are chlorine, bromine, fluorine and iodine.

Among the preferred compounds of this invention, the following are specified: $SnCl_2$, $SnCl_2.2H_2O$, $SnCl_4$, $SnCl_4.5H_2O$, $TiCl_3$, $ZrOCL_2.8H_2O$, $GeCl_2$, $GeBr_4$, basic lead acetate, tin dichloride di(acetylacetonate), hydroxyethyl zirconium triacetylacetonate, the acetylacetonates of Sn, Pb, Zr and Hf, zirconium acetates and basic acetates, triphenyltin acetate and tribenzyltin hydroxide.

Tin, lead and zirconium compounds are particularly preferred.

As already mentioned above, the application of the active compounds may be effected by a number of techniques. The following ones are generally preferred:

(A) The compound or the mixture of compounds to be used is dissolved or dispersed in an aqueous medium. This medium may contain organic solvents for the compound and for the substrate, dispersing agents, thickeners, detergents, thixotropic agents, surface active agents, hydrotropic agents, colouring agents, mordants, and others. It is strongly emphasized that if surface active agents are present, they act as primers only, i.e. to spread the treating mixture uniformly onto the substrate. After treatment, they are removed completely by washing and have no further utility.

The treating mixture may then be applied by any conventional technique, such as brushing, spraying, dipping, roller coating and so on. The temperature during treating is of no critical significance and the composition can be prepared and used, in most cases, at room temperature.

(B) The compound or the mixture of compounds to be used is dissolved or dispersed in an organic medium.

This medium may comprise one or more water-miscible organic solvents or non-solvents, dispersing agents, thickeners, surface active agents, detergents, colouring agents, thixotropic agents, and others. The mixture is then applied to the solid substrate surface as set forth under (A) above.

The contact times in methods (A) and (B) are not critical and 0.5 second is quite sufficient. However, times until 10 seconds, and more, e.g. 30 seconds, are of no harm.

The surface active agents which might be present in the compositions of methods (A) and (B) do not confer any durable wettability to the solid substrate. Therefore their choice is not critical provided they are compatible with the other components of the composition, are easily soluble or dispersible, have a convenient superficial activity in the medium selected (pH, organic solvents) and do not react in an undesired manner with the active compounds of the invention. Anionic active substances such as "Teepol", sold by Shell Co., are preferred in aqueous compositions.

As indicated above, there can be no appreciable reduction, decomposition or hydrolysis of the metal compounds when they are applied to the substrate. Such reactions might occur for example if, after application, the substrate or metal compound, or both, is heated to a sufficiently high degree, in or out of the presence of a water.

After having carried out one or both of the methods outlined above, it is necessary to post-treat the wettable surface to remove the excess of the treating compositions and their auxiliary components. This post-treatment can be effected by thoroughly washing the substrate with tap or distilled water.

The so treated surfaces are easily wettable, and the wettability persists until the article or surface is mechanically treated, as by strong rubbing, brushing, swiping, sand blasting, etc.

The active compounds or mixtures thereof with different activities may be chosen so as to confer to the substrate the desired wettability via its elevated surface tension. In other words, if the surface is to be made wettable with water ($\delta_f \cong 72$ dyn/cm), the activity of the compound to be selected must be greater than if the same surface is to be made wettable with benzene ($\delta_f \cong 30$ dyn/cm). As a general rule, the surface tension of the solid should be made as great as that of the fluid by which it is to be wetted, or even greater. Good results are always obtained when the new and elevated surface tension of the solid substrate is within ±10% of the value of the fluid's surface tension, but any excess of this value is not harmful.

The surface of the normally solid substrates to be treated may be cleaned before treatment, but it is to be noted that dirty and contaminated surfaces can also be made perfectly wettable since the nature of the substrate is without any importance, as outlined above.

The concentration of the active compounds, by using methods (A) and (B) above, in the treating composition is not critical. It may be in the range of 0.001 to 30% by weight of the composition, depending on the use contemplated. Concentrations of from 0.1 to 20% by weight are preferred, and from 0.5 to 5% are particularly preferred.

The mechamism of achieving the depicted activity is not entirely known. Without limiting the scope of the invention, it is believed that a strongly adhering mono- or oligomolecular coating is formed on the surface of the substrate and that with most of the compounds used, oxygen containing groups thereof enhance the activity of the above specified active metals.

The method of this invention finds numerous applications. Examples are: Increasing the wettability of ores and minerals in flotation processes, condensation of vapors and gases in condensation equipment, vacuum metal coating of various substrates, printing processes of plastic materials, finishing of textiles such as towels and wiping-clothes to make them wettable, increasing efficiency of sprayers, nozzles and atomizers, e.g. in spray drying equipment, increasing the throughput of tubing, enhancement of spreading of varnishes and laquers, e.g. on metal surfaces (car industry), increasing efficiency in cooling towers, increasing the tensile strength and flexural strength of concrete, enhancing the adhesion properties of adhesives, increasing lubricating properties of oils, and so on. By way of illustration, several examples of specific applications are offered. These examples by no means exhaust the versatility of the method and are not to be construed as limiting the invention.

The first 9 examples demonstrate the preparation and composition of treating formulations.

EXAMPLES I TO IX

The components tabulated below are mixed in any order. Preferably, the solvent is prepared first and the components are added until perfect solution or dispersion is achieved, generally at room temperature. Gentle warming, up to about 60° C. may be applied to accelerate solution or dispersion.

The compositions are given in Table I below. All figures given are in parts by weight.

Table I

| | Treating compositions | | | | | | | | |
|---|---|---|---|---|---|---|---|---|---|
| | Example No. | | | | | | | | |
| Composition | I | II | III | IV | V | VI | VII | VIII | IX |
| Solvents | | | | | | | | | |
| Water | 1000 | 1000 | 1000 | 1000 | 1000 | 800 | 1000 | — | — |
| ethanol | — | — | — | — | — | 100 | — | — | — |
| acetone | — | — | — | — | — | — | — | — | 1000 |
| propylene-glycol | — | — | — | — | — | — | — | 1000 | — |
| active components | | | | | | | | | |
| $SnCl_2 . 2H_2O$ | 100 | — | 50 | 50 | — | — | — | 200 | 200 |
| $TiCl_3$*) | 30 | 50 | — | — | — | — | — | — | — |
| $ZrOCl_2 . 8H_2O$ | — | 100 | 50 | — | 100 | — | — | — | — |
| $Pb(ac)_2$+) | — | — | — | 50 | — | 100 | — | — | — |
| $GeCl_2$ | — | — | — | — | — | — | 100 | — | — |

Table I-continued

| Composition | Treating compositions Example No. I | II | III | IV | V | VI | VII | VIII | IX |
|---|---|---|---|---|---|---|---|---|---|
| auxiliary matter | | | | | | | | | |
| surfactant** | 0.3 | 1.0 | 1.0 | 1.0 | 1.0 | 1.0 | 2.0 | — | — |
| HCl conc. | — | — | — | 50 | — | — | 80 | — | — |
| 1N-NaOH | — | — | — | — | — | 150 | — | — | — |
| $NH_4Cl$ | 60 | — | — | — | — | — | — | — | — |

*) a 15% by weight aqueous solution
**) "Teepol", a secondary alkyl sulfonate
+) ac = acetate radical

EXAMPLES X TO XVIII

The following examples demonstrate the wetting of non-wettable surfaces before and after treatment by the method of the invention. Methods (A) and (B) described above were used.

The tests were carried out as follows:

Methods (A) and (B)

A sheet about 5 × 15 cm, 2 to 4 mm thick, of the material to be tested, was cut into two strips of 2.5 × 15 cm each. One of them served as a control. The other strip was immersed for less than one second in a treating solution containing at least one of the active compounds. It was removed from the solution, washed with running tap water of about 15° C. for at least five minutes, and then, still water wet or after drying, slowly introduced into pure water. The contact angle between water and the solid strip was measured while slowly introducing and slowly removing the strip. From these angles, the surface energy of the solid substrate was calculated, as outlined above, by using $\delta_f$ = 72.8 dyn/cm. The untreated control strip was used, in the same manner, to measure contact angles and to calculate surface tensions of the untreated materials. The measurements were carried out at room temperature (about 20° C.). Table II below compiles the values measured and the solid surface tensions calculated.

The following symbols are used in Table II:

$\nu_a$ contact angle between solid surface and water, on introducing the substrate (degrees)

$\nu_r$ contact angle between solid surface and water, on removing the substrate (degrees)

$\delta_{sa}$ surface tension of the solid substrate, calculated from $\nu_a$ (dyn/cm)

$\delta_{sr}$ surface tension of the solid substrate, calculated from $\delta_r$ (dyn/cm)

Table II

| Solid substrate | Control (untreated) $\theta_a$ | $\theta_r$ | $\sigma_{sa}$ | $\sigma_{sr}$ | Increasing of solid surface tensions: Example X $\theta_a$ | $\theta_r$ | $\sigma_{sa}$ | $\sigma_{sr}$ | Example XI $\theta_a$ | $\theta_r$ | $\sigma_{sa}$ | $\sigma_{sr}$ | Example XII $\theta_a$ | $\theta_r$ | $\sigma_{sa}$ | $\sigma_{sr}$ |
|---|---|---|---|---|---|---|---|---|---|---|---|---|---|---|---|---|
| Polypropylene | 93 | 54.5 | 29.5 | 56 | 78 | 9.5 | 40 | 72 | 76.5 | 0 | 41 | 72.8 | 52.5 | 0 | 57 | 72.8 |
| "Viton"[a] | 98 | 27.5 | 26 | 68.5 | 72.5 | 7 | 44 | 72.5 | 90 | 34 | 31.8 | 66 | 69.5 | 4.5–0 | 46 | 72.5–72.8 |
| PVC, hard | 72 | 42.5 | 44.5 | 62.5 | 79 | 17 | 40 | 71 | 64.5 | 11 | 49 | 72 | 44 | 9 | 61.5 | 72.8 |
| "Vulkollan" 950[b] | 90 | 43 | 31.8 | 62 | 75.5 | 21 | 42 | 70 | 80.5 | 12 | 38.5 | 72 | 43.5 | 0 | 61.5 | 72.8 |
| Nylon | 66.5 | 38.5 | 48 | 64 | 85 | 59 | 35 | 53 | 100 | 39.5 | 24.3 | 63.5 | 45 | 0 | 61 | 72.8 |
| Polyethylene, soft | 90 | 65 | 31.8 | 49 | 76.5 | 14.5 | 41 | 71.5 | 80.5 | 11 | 38.5 | 72 | 27 | 0 | 68.5 | 72.8 |
| Teflon | 108 | 65 | 19 | 49 | — | — | not | wettable | 123 | 44 | 10 | 61.5 | 68 | 0 | 47 | 72.8 |
| Rubber | 124 | 66.5 | 9.5 | 48 | — | 59.5 | — | 53 | 113.5 | 30.5 | 15 | 67.5 | 36.5 | 0 | 65 | 72.8 |
| Dextrine | 90 | 61 | 31.8 | 52 | 90 | 40 | 31.8 | 63.5 | 84 | 17.5 | 36 | 71 | 47 | 0 | 60 | 72.8 |
| Aluminum | 92 | 58.5 | 30 | 53.5 | 90 | 49 | 31.8 | 58.5 | 90 | 21 | 31.8 | 70 | 44.5 | 0 | 61 | 72.8 |
| Copper | 81.5 | 32.5 | 38 | 68.5 | 90 | 7 | 31.8 | 72.5 | 99 | 16.5 | 25.5 | 71 | 62 | 0 | 51 | 72.8 |
| Bronze | 78 | 29 | 40 | 68 | — | 9 | — | 72 | 95.5 | 12 | 28 | 71.5 | 57.5 | 0 | 54 | 72.8 |
| Brass | 94.5 | 63 | 28.5 | 50.5 | — | 12.5 | — | 71.5 | 86 | 0 | 36 | 72.8 | 56 | 0 | 55 | 72.8 |
| Steel, chromed | 90 | 76 | 31.8 | 41.5 | 74.5 | 12.5 | 43 | 71.5 | 98.5 | 43 | 26 | 62 | 56 | 0 | 55 | 72.8 |
| Steel, polished | 90 | 66 | 31.8 | 48.5 | 67.5 | 0 | 47 | 72.8 | 77.5 | 0 | 40.5 | 72.8 | 56.5 | 0 | 55 | 72.8 |
| Steel, nickeled | 90 | 59.5 | 31.8 | 53 | 77 | 11.5 | 40.5 | 72 | 93 | 12.5–0 | 29.5 | 71.5 | 82.5 | 13 | 36.5 | 71.5 |
| Quartz | 92 | 8.5 | 67 | 72 | 23 | 8.5 | 69.5 | 72 | 47 | 9.5 | 60 | 72.8 72.8 | 19 | 6 | 70.5 | 71.5 |

| Solid substrate | Example XIII $\theta_a$ | $\theta_r$ | $\sigma_{sa}$ | $\sigma_{sr}$ | Example XIV $\theta_a$ | $\theta_r$ | $\sigma_{sa}$ | $\sigma_{sr}$ | Example XV $\theta_a$ | $\theta_r$ | $\sigma_{sa}$ | $\sigma_{sr}$ |
|---|---|---|---|---|---|---|---|---|---|---|---|---|
| Soft polyethylene | 71.5 | 25 | 44.5 | 69 | 97.5 | 66 | 26 | 48.5 | 48 | 14 | 59.5 | 71.5 |
| Soft Teflon | 109 | 31.5 | 18.5 | 67 | 119.5 | 35 | 12 | 65.5 | 92 | 0 | 30 | 72.8 |
| Rubber | 79 | 0 | 39.5 | 72.8 | 127.5 | 76 | 8.5 | 41.5 | 93 | 39 | 29.5 | 64 |
| Polypropylene | 77.5 | 21 | 40.5 | 70.5 | 99.5 | 52 | 25 | 57 | 60 | 15 | 52.5 | 69 |
| Aluminum | 77 | 13.5 | 41 | 71.5 | 85 | 25.5 | 35 | 65.5 | 79 | 23 | 39.5 | 69.5 |

| | Example XVI | | | | Example XVII | | | | Example XVIII | | | |
|---|---|---|---|---|---|---|---|---|---|---|---|---|
| Soft polyethylene | 54.5 | 0 | 56 | 72.8 | 64.5 | 0 | 49 | 72.8 | 8.5 | 0 | 72 | 72.8 |
| Soft Teflon | 100 | 0 | 22.5 | 72.8 | 80.5 | 0 | 38.5 | 72.8 | 31.5–0 | 0 | 67–72.8 | 72.8 |
| Rubber | 80 | 0 | 38 | 72.7 | 125 | 67.5 | 9.5 | 47.5 | 92 | 0 | 30 | 72.8 |
| Polypropylene | 49.5 | 9 | 58.5 | 72 | 82.5 | 22 | 37 | 70 | 59 | 0 | 53 | 72.8 |
| Aluminum | 72 | 16 | 44.5 | 71 | 73 | 19 | 43.5 | 70.5 | 57.5 | 0–7 | 54 | 72.5–72.8 |

[a] "Viton" is a Du Pont fluoroelastomer
[b] "Vulkollan" is a diisocyanate-polyester (Farbenfabriken Bayer, Germany)

It should be noted that where the contact angle $\nu$ was found to be 0°, the corresponding $\delta_s$-value was inserted as 72.8, the $\delta_f$-value of water as the test fluid. However, this value may in fact be higher since cos $\nu$ in this case is zero and may correspond to all $\delta_s$-values greater than $\delta_f$.

The treating solutions used in the Examples X to XVIII are compiled in Table III below.

Table III

| Composition (parts by wt.) | Example No. X | XI | XII | XIII | XIV | XV | XVI | XVII | XVIII |
|---|---|---|---|---|---|---|---|---|---|
| Solvents | | | | | | | | | |
| water | — | — | — | 125 | 80 | 80 | — | — | — |
| methanol | — | — | — | — | — | — | 62.5 | 62.5 | 156 |
| ethanol | 97 | 97 | 97 | — | — | — | — | — | — |
| active compound | | | | | | | | | |
| zirconyl chloride | 3 | — | — | 1.96 | 8 | 8 | — | — | — |
| zirconium acetylacetonate | — | 3 | — | — | — | — | 0.24 | 2.4 | — |
| tin dichloride di(acetylacetonate | — | — | 3 | — | — | — | — | — | 6 |
| auxiliary matter | | | | | | | | | |
| Teepol | — | — | — | 0.125 | — | 0.08 | — | — | — |

It must be emphasized that in those Examples (XIII and XV) where surfactant-containing solutions were used, the substrate was washed with lukewarm tap water (30° C) after treatment for such a long time that no more surfactant (Teepol) could be detected on the substrate.

However, comparing Examples XIV and XV where identical solutions were used with the only difference that the solution of Example XV contained about 0.1% of Teepol, it is evident that the increase of the solid surface tensions $\delta_{sa}$ and $\delta_{sr}$ is improved. This is evidently due to a better primary wetting of the substrate specimen treated since no Teepol is left on the substrate after washing and before measuring the contact angles. As a general rule, the addition of surface active agents to the treating liquid is indicated only in such cases where water is the "carrier" of the active compound in the treating composition.

From Examples X to XVIII, it is clear that treatment in accordance with the invention results in a very substantial increase in solid surface tensions. Furthermore, it is evident that the increase in solid surface tension may be controlled by the use of a specific solvent, a specific active compound, its concentration, and auxiliary matter in the treating composition. For instance, in comparing Examples XVI and XVII, it can be seen that with a ten fold increase in concentration of the active compound in the treating composition, the increase of solid surface tension is somewhat lower.

The most important result of the treatment is that substrates which are very difficult to wet, such as Teflon, polypropylene, and rubber, can be made perfectly wettable even to pure water, a feature which has not been obtained until now.

EXAMPLE XIX

The treatment as set forth in Examples X to XII was repeated, with the exception that instead of 97 parts by weight of ethanol, 97 parts of a 10% ethanolic shellac solution was used. The compositions were brushed on the surface of the test strip which had been previously cleansed with pure ethanol. The test strip was then immediately flushed with a large quantity of water.

All so treated substrates showed perfect wettability to pure or tap water even when the substrate had to be dried before measuring the contact angles. The wettability did not change after strongly rubbing the treated surfaces with a cloth.

EXAMPLES XX TO XXV

These Examples illustrate spreading of droplets of various liquids on surfaces of solid substrates.

It is well known that non-wettable surfaces do not permit the spreading of drops of the specific liquid concerned. With the treatment of the present invention however, the spreading of droplets becomes possible and is a measure of the increase in surface tension obtained.

The specific substrate chosen was treated as set forth in Examples X to XVIII above. The water-flushed substrate was dried, and after complete drying, 0.1 ml of the liquid to be tested was applied on the horizontal substrate. After 5 minutes (4 hours with paraffine oil due to its elevated viscosity), the diameter of the droplet was measured and the contact surface area with the substrate was calculated and expressed in $cm^2$. All tests were carried out at 20° C.

The results obtained are tabulated in Table V below. In Table IV, the treating compositions are given.

Table IV

| Composition (parts by wt.) | Composition of treating solutions ST | SA | ZA | ZO |
|---|---|---|---|---|
| Solvents | | | | |
| water | 86.1 | — | — | — |
| ethanol | | 97 | 97 | 97 |
| active compound | | | | |
| zirconyl chloride | — | — | — | 3 |
| zirconium acetylacetonate | — | — | 3 | — |
| tin dichloride di(acetylacetonate) | — | 3 | — | — |
| tin dichloride . $2H_2O$ | 8.4 | — | — | — |
| titanium trichloride | 0.4 | — | — | — |
| auxiliary matter | | | | |
| ammonium chloride | 5.1 | — | — | — |

Table V

| Material | Droplet spreading tests — Droplet surface, 5 min after droplet application ($cm^2$) — Example XX, water: untreated | treated with composition: ST | SA | ZA | ZO | Example XXI, ethanol: untreated | treated with composition: ST | SA | ZA | ZO | Example XXII, acetone: untreated | treated with composition: ST | SA | ZA | ZO |
|---|---|---|---|---|---|---|---|---|---|---|---|---|---|---|---|
| Aluminum | 0.64 | 0.8 | 0.5 | 1.55 | 1.1 | 1.6 | 3.8 | 32 | 28 | 38.5 | 2.0 | 28 | 16 | 12.5 | 23 |
| Copper | 0.5 | 0.65 | 1.0 | 1.55 | 1.5 | 2.0 | 44 | 38.5 | 44 | 44 | 3.8 | 33 | 19.5 | 16 | 23 |
| Steel | 0.79 | 1.1 | 1.1 | 0.95 | 1.1 | 2.0 | 44 | 38.5 | 32 | 44 | 2.5 | 24 | 12.5 | 16 | 19.5 |

Table V-continued

| | Droplet spreading tests | | | | | | | | | | | | | | |
|---|---|---|---|---|---|---|---|---|---|---|---|---|---|---|---|
| Rubber | 0.38 | 0.5 | 1.1 | 0.79 | 1.1 | 1.8 | 44 | 33.5 | 50 | 38.5 | 2.3 | 33 | 12.5 | 7 | 19.5 |
| Teflon | 0.28 | 0.3 | 2.0 | 0.95 | 0.8 | 1.6 | 44 | 44 | 28 | 12.6 | 1.5 | 24 | 19.5 | 10 | 7 |
| Polypropylene | 0.73 | 0.8 | 1.1 | 1.55 | 3.8 | 1.5 | 44 | 38.5 | 33 | 47.5 | 1.1 | 28 | 11 | 7 | 19.5 |
| Polyethylene | 0.5 | 0.5 | 0.5 | 1.13 | 1.5 | 2.6 | 38 | 28.5 | 46 | 36.5 | 1.5 | 24 | 16 | 19 | 16 |
| Glass | 1.54 | 9.5 | 0.8 | 1.36 | 4.5 | 3.2 | 44 | 38.5 | 32.5 | 44 | 7.1 | 19.5 | 12.5 | 19.5 | 19.5 |

| | Droplet surface, 5 min after droplet application ($cm^2$) a) | | | | | | | | | | | | | | |
|---|---|---|---|---|---|---|---|---|---|---|---|---|---|---|---|
| | Example XXIII, paraffine oil | | | | | Example XXIV, benzene | | | | | Example XXV, ethyl acetate | | | | |
| | un- | treated with composition | | | | un- | treated with composition | | | | un- | treated with composition | | | |
| Material | treated | ST | SA | ZA | ZO | treated | ST | SA | ZA | ZO | treated | ST | SA | ZA | ZO |
| Aluminum | 1.6 | 19.5 | 12.5 | 38 | 19.5 | 4.8 | 9.5 | 7.5 | 7 | 4.9 | 3.8 | 16 | 12.5 | 10 | 9 |
| Copper | 1.8 | 16 | 19.5 | 29 | 33 | 3.2 | 9.5 | 9.5 | 7 | 12.5 | 7.0 | 24 | 12.5 | 13 | 19.5 |
| Steel | 1.8 | 24 | 28 | 24 | 28 | 2.8 | 7 | 9.5 | 10 | 7 | 4.2 | 19.5 | 12.5 | 7.5 | 16 |
| Rubber | 1.1 | 9.5 | 12.5 | 19.5 | 28 | 1.7 | 7 | 4.8 | 5 | 4.9 | 3.8 | 19.5 | 7.1 | 7.5 | 12.5 |
| Teflon | 0.8 | 16 | 9.6 | 33 | 1.1 | 1.0 | 9.5 | 9.5 | 10 | 4.9 | 2.5 | 19.5 | 12.5 | 13 | 9 |
| Polypropylene | 7.0 | 16 | 12.5 | 13 | 4.2 | 1.2 | 9.5 | 7.5 | 7 | 7 | 3.8 | 24 | 9.5 | 10 | 16 |
| Polyethylene | 3.2 | 9.5 | 7.1 | 23 | 12.5 | 3.2 | 7 | 4.8 | 10 | 3.5 | 7.0 | 16 | 7.1 | 10 | 12.5 |
| Glass | 3.2 | 12.5 | 12.5 | 12.5 | 19.5 | 2.5 | 7 | 7.5 | 7 | 4.9 | 5.3 | 12.5 | 11 | 16 | 12.5 |

a) 4 hours in Example XXIII

EXAMPLE XXVI

In this example, the wetting treatment of fibrous textile substrates is illustrated.

The test method was adopted from K. Linder. "Textilhilfsmittel and Waschrohstoffe", Stuttgart 1954, p. 830, and is that developed by Seyferth and Morgan.

A canvas disk was treated for 2 minutes with the composition ST of Table IV, then removed and washed for 30 minutes in running tap water, dried and kept for 24 hours in a desiccator at constant relative humidity and temperature together, but not in contact, with an untreated canvas sample.

After this period, the time was measured until total immersion of the disk. A series of 10 tests was made, and the average values were recorded.

The immersion time of the untreated disk was more than 18 minutes, the mean immersion time of the treated disk 100 seconds.

With a 0.1% solution of Teepol 710, the immersion times were 4 minutes and 60 seconds, respectively.

The disks were separately kept in boiling water for 30 minutes, removed, dried, and again kept for 24 hours in a desiccator.

The immersion times in pure water were now 12 seconds for the control and 3 seconds for the treated disks.

This test reveals that keeping the treated disks in boiling water for a rather long time does not cause any change in wettability.

This Example shows clearly that the wettability of textiles can be permanently increased by the treatment of the invention.

EXAMPLE XXVII

Atomizer test

This Example uses an air humidifying equipment (Defensor, Zurich, Switzerland) having a rotating atomizer disk and a water supply cone.

A Defensor 505 unit was placed on a balance, filled with 6 liters of water and accurately weighed. The unit was removed from the balance and connected to the 220 volts means line via a Norma current recorder. The unit was started while a stop watch was simultaneously actuated. After 10 minutes, the unit was disconnected and weighed again. The weight lost was recorded (test No. 1).

The cone and the disk were then removed from the unit, treated with the composition ST of Table IV, washed with a great quantity of water, replaced into the unit, and the same procedure as indicated above was used. The power consumption in all tests was recorded, the voltage variations being below 1% (test No. 2).

The surfaces of the treated cone and disk were then coated with a thin paraffin layer by applying a solution of 10% by weight of paraffin in carbon tetrachloride, where upon the test procedure as described above was repeated (test No. 3). The results obtained are set forth in Table VI below. Each test was made twice.

Table VI

| Test Conditions | Test No. 1a | 1b | 2a | 2b | 3a | 3b |
|---|---|---|---|---|---|---|
| Water temperature in humidifier, ° C | 20 | 20 | 20 | 20 | 20 | 20 |
| relative humidity of surrounding air, % | 65–70 | | 65–70 | | 65–70 | |
| a.c. current consumption, amps | 0.25 ± 0.01 | | 0.26 ± 0.1 | | 0.25 ± 0.1 | |
| a.c. voltage, volts 220 ± 1 % | 220 ± 1 % | | 220 ± 1 % | | | |
| water atomized in 10 minutes, gms | 68 | 69 | 94 | 96 | 70 | 68 |

The operation of the untreated equipment without water showed a current consumption of 0.23–0.24 amps under 220 volts.

It can be seen that, with the treatment of the invention, nearly 40% more water may be atomized in unit time, without notable increase in power consumption.

EXAMPLE XXVIII

A rubber vacuum hose having a wall thickness of 3 mm, was perforated with a pin. A series of pin holes was made lying on a straight line on the hose. The hose was then closed at one end, and one half its length was treated with the composition ZA of Table IV above.

The hose was immersed in clean water and connected to a compressed air source of about 0.5 atmospheres gauge. A photograph was taken showing the formation of air bubbles at the pin holes.

FIG. 1 of the accompanying drawing was made from this photograph. The water surface is designed by 1, the water bulk by 4.

The hose 2 and 3 is untreated (portion 3) and treated (portion 2). The perforations or pin holes have been placed such as to be along the upper line of the hose. It can be seen that large bubbles 7 are formed on the untreated rubber surface 3, whereas the air leaves the hose from the treated surface 2 as fine filaments 6 of minuscule air bubbles to form a foamlike cloud 5.

FIG. 2 demonstrates the mechanism of this test. Since the treated surface 2 is more wettable to the liquid 4

(water in this case) than to the gas (air, in this case), very tiny bubbles 6 are formed which are easily released in a short time to form an air filament, whereas the untreated surface 3 is more wettable to the air so that relatively large air bubbles 7 are formed before they can leave the surface.

What is claimed is:

1. A method for increasing the surface tension of a normally solid and normally non-wettable substrate which consists of contacting the surface of the substrate with an aqueous solution or aqueous dispersion containing at least one compound selected from the group consisting of stannous chloride, titanium trichloride, zirconium oxychloride and germanium dichloride, for up to 30 seconds, and removing the excess of the solution or dispersion by thoroughly rinsing the surface of the thus treated substrate with water.

2. A method for increasing the surface tension of a normally solid and normally non-wettable substrate which consists of contacting the surface of the substrate with an aqueous solution or aqueous dispersion containing a mixture of stannous chloride and plumbous acetate, for up to 30 seconds, and removing the excess of the solution or dispersion by thoroughly rinsing the surface of the thus treated substrate with water.

3. A method according to claim 1, wherein the contact time is 0.5–30 seconds.

4. A method according to claim 2, wherein the contact time is 0.5–30 seconds.

5. A method according to claim 1, wherein the total concentration of the compound or compounds in the aqueous solution or aqueous dispersion is 0.1 to 20% by weight.

6. A method according to claim 1, wherein the total concentration of the compound or compounds in the aqueous solution or aqueous dispersion is 0.5 to 5% by weight.

7. A method according to claim 2, wherein the total concentration of the stannous chloride and plumbous acetate in the aqueous solution or aqueous dispersion is 0.1 to 20% by weight.

8. A method according to claim 2, wherein the total concentration of the stannous chloride and plumbous acetate in the aqueous solution or aqueous dispersion is 0.5 to 5% by weight.

9. The method according to claim 1, wherein the aqueous solution or aqueous dispersion contains stannous chloride and titanium trichloride.

10. The method according to claim 1, wherein the aqueous solution or aqueous dispersion contains zirconium oxychloride and titanium trichloride.

11. The method according to claim 1, wherein the aqueous solution or aqueous dispersion contains stannous chloride and zirconium oxychloride.

12. The method according to claim 1, wherein the aqueous solution or aqueous dispersion contains zirconium oxychloride.

13. The method according to claim 1, wherein the aqueous solution or aqueous dispersion contains germanium dichloride.

14. The method according to claim 1, wherein the aqueous solution or aqueous dispersion contains stannous chloride.

* * * * *